US009085439B2

(12) United States Patent
Pellengo Gatti

(10) Patent No.: US 9,085,439 B2
(45) Date of Patent: Jul. 21, 2015

(54) SPINDLE FOR WINDING UP CORELESS ROLLS OF A PLASTIC FILM

(75) Inventor: Roberto Pellengo Gatti, San Pietro Mosezzo (IT)

(73) Assignee: NO.EL. S.R.L., San Pietro Mosezzo (IT)

( * ) Notice: Subject to any disclaimer, the term of this patent is extended or adjusted under 35 U.S.C. 154(b) by 0 days.

(21) Appl. No.: 13/984,297

(22) PCT Filed: Mar. 22, 2012

(86) PCT No.: PCT/EP2012/055062

§ 371 (c)(1),
(2), (4) Date: Aug. 8, 2013

(87) PCT Pub. No.: WO2012/126977

PCT Pub. Date: Sep. 27, 2012

(65) Prior Publication Data

US 2013/0341456 A1 Dec. 26, 2013

(30) Foreign Application Priority Data

Mar. 24, 2011 (IT) ..... MI2011A0467

(51) Int. Cl.

| | |
|---|---|
| ***B65H 19/28*** | (2006.01) |
| ***B65H 75/18*** | (2006.01) |
| ***B65H 75/10*** | (2006.01) |
| ***B65H 19/22*** | (2006.01) |
| ***B65H 19/30*** | (2006.01) |

(52) U.S. Cl.

CPC ..... *B65H 75/18* (2013.01); *B65H 19/2276* (2013.01); *B65H 19/30* (2013.01); *B65H 75/10* (2013.01); *B65H 2401/13* (2013.01); *B65H 2404/40* (2013.01); *B65H 2406/113* (2013.01)

(58) Field of Classification Search

CPC ..... B65H 19/28; B65H 19/2276; B65H 2301/41425; B65H 2301/41426

USPC ..... 242/532, 532.2, 581, 610

See application file for complete search history.

(56) References Cited

U.S. PATENT DOCUMENTS

| | | | | |
|---|---|---|---|---|
| 5,337,968 | A | 8/1994 | De Bin et al. | |
| 5,452,496 | A * | 9/1995 | Long et al. | 19/308 |
| 5,857,641 | A * | 1/1999 | Goode | 242/583 |
| 6,186,436 | B1 | 2/2001 | Selle et al. | |
| 6,595,458 | B1 | 7/2003 | Biagiotti | |
| 6,695,245 | B1 * | 2/2004 | Schultz et al. | 242/532.2 |

(Continued)

FOREIGN PATENT DOCUMENTS

| | | |
|---|---|---|
| JP | 2003-73036 | 3/2003 |
| WO | 2006/012933 | 2/2006 |

OTHER PUBLICATIONS

International Search Report Dated Issued in PCT/EP2012/055062.

(Continued)

*Primary Examiner* — Sang Kim

(74) *Attorney, Agent, or Firm* — Silvia Salvadori, P.C.

(57) ABSTRACT

A spindle (10) suitable for winding up coreless rolls (11) of a stretchable plastic film; the spindle (10) comprises a tubular body having a peripheral wall (12) defining at least one internal chamber (14) connectable to a pressurized air source. A plurality of perforations (17) extends from the internal chamber (14) of the spindle (10), through the peripheral wall (12) and a protective layer (19) of hard chrome having a sandblasted outer surface (18) with an average roughness ranging between 6 and 6.5 μm, obtained by dry sandblasting.

7 Claims, 2 Drawing Sheets

(56) References Cited

U.S. PATENT DOCUMENTS 7,611,087 B2 * 11/2009 Gatti ..... 242/412.2
7,641,141 B2 * 1/2010 Pellengo Gatti ..... 242/532.2

OTHER PUBLICATIONS

Written Opinion of the International Searching Authority Issued in PCT/EP2012/055062.

* cited by examiner

SPINDLE FOR WINDING UP CORELESS ROLLS OF A PLASTIC FILM

This application is a U.S. national stage of PCT/EP2012/055062 filed on Mar. 22, 2012, which claims priority to and the benefit of Italian Application No. MI2011A000467, filed on Mar. 24, 2011, the contents of which are incorporated herein by reference.

BACKGROUND OF THE INVENTION

The present invention relates to a spindle for winding up coreless rolls of a plastic film, in particular rolls of a stretchable plastic film suitable for packaging and/or for wrapping palletized loads or other applications.

STATE OF THE ART

Stretchable plastic films, wound up in rolls, are typically used in the packaging field, for example, to wrap and stabilize loads and/or goods stacked on support pallets.

Generally, the plastic film is wound up on a small rigid tubular core in paperboard or plastic material, which has to be threaded in advance on a spindle of a winding machine to wound a plastic roll or manually used by a handle to unwound the roll. The use of small rigid cores in paperboard or plastic material is necessary in order to allow a proper winding of the plastic film rolls, as well as to facilitate the withdrawal thereof at the end of the winding step. However, the use of conventional small rigid tubular cores necessarily involves some drawbacks in the provision and storage of new tubular cores, as well as the disposal of the exhausted cores, with associated increased costs.

The replacement of the conventional rolls of plastic film wound up on small rigid cores, with coreless rolls, has long been sought, by directly forming the rolls on a spindle that, after the removal from the winding machine, could be withdrawn from the roll only after a preset period of time needed to allow the roll to stabilize, in order to avoid any implosion risk.

In an attempt to improve this technology, it has also been proposed, both in the packaging plastic film field, and in other fields, the use of drilled spindles having a perforate peripheral wall comprising a tubular chamber connectable to a pressurised air source, and the supply of pressurised air through the same spindle and the perforated wall in order to cause a slight expansion of the internal turns of the roll, and an air flow which facilitates the withdrawal of the roll without having to remove the spindle from the winding machine.

The use of a perforated spindle for winding up coreless rolls of a stretchable plastic film is shown, for example, in WO-A-2006/012933 of the same Applicant; other examples for winding up web material, for example, paper or fabric, are described in U.S. Pat. No. 5,337,968; U.S. Pat. No. 6,186,436; and U.S. Pat. No. 6,595,458.

In particular, WO-A-2006/012933 discloses a spindle comprising a tubular body provided with a peripheral wall that defines an internal chamber axially extending along the spindle, which is connectable to a pressurised air source; the peripheral wall is provided with a plurality of perforations extending from the internal chamber to the external surface of the spindle, for winding up the plastic film and forming the roll.

In practice, the spindle is composed of a metal tubular body, the external surface of which for winding up the film has to be suitably ground and made perfectly smooth, so as to minimize the frictional forces which would prevent the sliding and withdrawal of the roll; furthermore, the pressurised air that is ejected through the spindle perforations causes a radial expansion and a compaction of the inner turns of the roll, thus allowing to easily withdrawing the roll from the spindle, in the absence of frictional forces and without causing any deformation of the same roll, or implosion of the inner turns thereof.

However, during the use of such a spindle, a high compressed air consumption has been noted, that is necessary, on the other hand, to cause the radial expansion of the inner turns of the roll upon the withdrawal.

Besides a reduction of the compressed air consumption, there is also the need to adhere automatically the plastic film to the external surface of the spindle, at the beginning of the film winding step. This second need, which partially contrasts with the need to reduce the frictional forces upon the withdrawal of the roll, is incompatible with the previous one, and not easy to solve.

In an attempt to partially obviate this drawback, U.S. Pat. No. 5,337,968 suggests to connect the perforated spindle to a vacuum pump, at the beginning of the winding step of the web material, so as to create a vacuum degree by suctioning air through the spindle perforations, in order to initially adhere the web material against the external surface of the spindle.

Such a solution, beside being constructively and functionally complex, is not applicable to plastic film winding machines in which use is made of compress air to cause the radial expansion of the inner turns of the roll upon the withdrawal, since, in order to generate the powerful air jets necessary to expand the turns of the roll, perforations are needed having a small diameter, of the order of a millimeter, slightly greater or smaller; on the contrary, to draw the film and make it to pneumatically adhere to the spindle at the beginning of the winding step, perforations would be needed having a considerably greater diameter, so as to generate a vacuum degree or underpressure condition necessary to draw the film. These two operative conditions are mutually incompatible, and it does not seem that they can co-exist in a single spindle.

Finally, in the conventional spindles, in which the exit holes for air jet open on a smooth surface, that is deemed necessary to reduce the frictional forces upon withdrawal of the rolls, withdrawal difficulties have sometimes occurred due to an unhomogeneous distribution of the pressurised air cushioning between opposed surfaces of the spindle and the roll, presumably due to an irregular radial expansion of the roll.

OBJECTS OF THE INVENTION

Therefore, the need exists to find a new and different solution, which allows obviating the drawbacks indicated before, by reducing the consumption of pressurised air necessary to cause the radial expansion of the internal turns of the roll during the removal.

Therefore an object of the invention is to provide a spindle suitable for winding up coreless rolls of plastic films, in particular, stretchable films, which is provided with a plurality of perforations for the generation of air jets and a film winding surface suitably configured to provide a low frictional force, as well as to allow the creation of an uniform air cushioning along the entire spindle, during the withdrawal step of a roll.

A further object of the invention is to provide a spindle as defined before, that is also provided with a film winding surface, which is suitably treated to allow an automatic adhesion of the plastic film at the beginning of the winding of a roll, as well as provided with a high hardness and wear and/or etching resistant surface, while maintaining such features for a prolonged working period of time.

BRIEF DESCRIPTION OF THE INVENTION

What stated above can be achieved by a spindle suitable for winding up coreless rolls of a plastic film, in particular a stretchable film, according to claim 1.

According to the invention, a spindle suitable for winding up and removing coreless rolls of a plastic film, as defined before, has been provided, wherein the spindle comprises:

a tubular body having a peripheral wall and at least a coaxially extending internal chamber, connectable to a pressurised air source; and in which the peripheral wall of the spindle comprises a plurality of perforations extending from the internal chamber to an external surface for winding up a roll, characterized in that the peripheral wall of the spindle has a protective surface layer of hard chrome defining the external surface for winding up the roll, having an average roughness between 6 and 6.5 μm, obtained by sandblasting.

Sandblasting is a mechanical process by which it is aimed to erode the surface portion of a material, by means of sand and air jets oriented against the surface to be treated.

Sandblasting is frequently used for the surface cleaning of metals or materials in general, or to etch writings and/or images on marble and stones, as well as to confer to the treated surface a final aesthetical appearance.

At the end of a sandblasting operation, the treated surface has a degree of roughness that depends on both the dimensions of the grains of sand that are used, and the pressure of the jet.

Generally, the dimensions of the sand grains can by average range from about 0.250 mm to 1 mm, typically using grains of sand having greater dimensions when operating on hard materials.

A typical sandblasting operation, conversely to the needs of the present invention, tends to roughen the treated surface and to increase the frictional forces; furthermore, from the first tests that have been carried out, it has been ascertained that an incorrect sandblasting, besides negatively increasing the frictional forces, tends to create an excessive consumption of compressed air. Therefore, sandblasting would seem completely unsuitable for a surface treatment of spindles for winding up and removal of coreless rolls, in which use is made of pressurised air jets in order to withdraw the roll at the end of the winding step.

Against all expectations, instead, it has been ascertained that by carrying out a sandblasting under preset conditions, both an initial automatic adhesion of the plastic film to the sandblasted surface of the spindle, and the creation of an homogeneous air cushioning between the roll and the spindle, with consequent low frictional force between the opposite surfaces of the roll and the spindle and a reduced consumption of pressurised air is made possible.

BRIEF DESCRIPTION OF THE DRAWINGS

These and further characteristics of the spindle according to the present invention will be more apparent from the following description and the annexed drawing, in which.

DETAILED DESCRIPTION OF THE INVENTION

Figure 1:
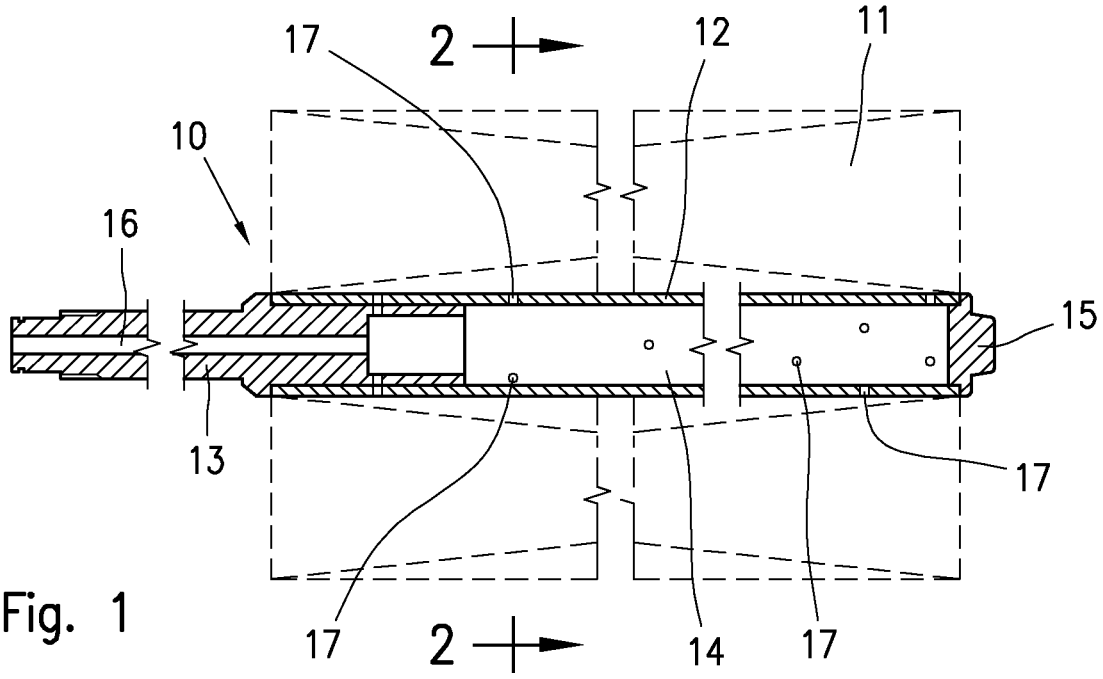
FIG. 1 is a longitudinal cross-sectional view of the spindle.
Figure 2:
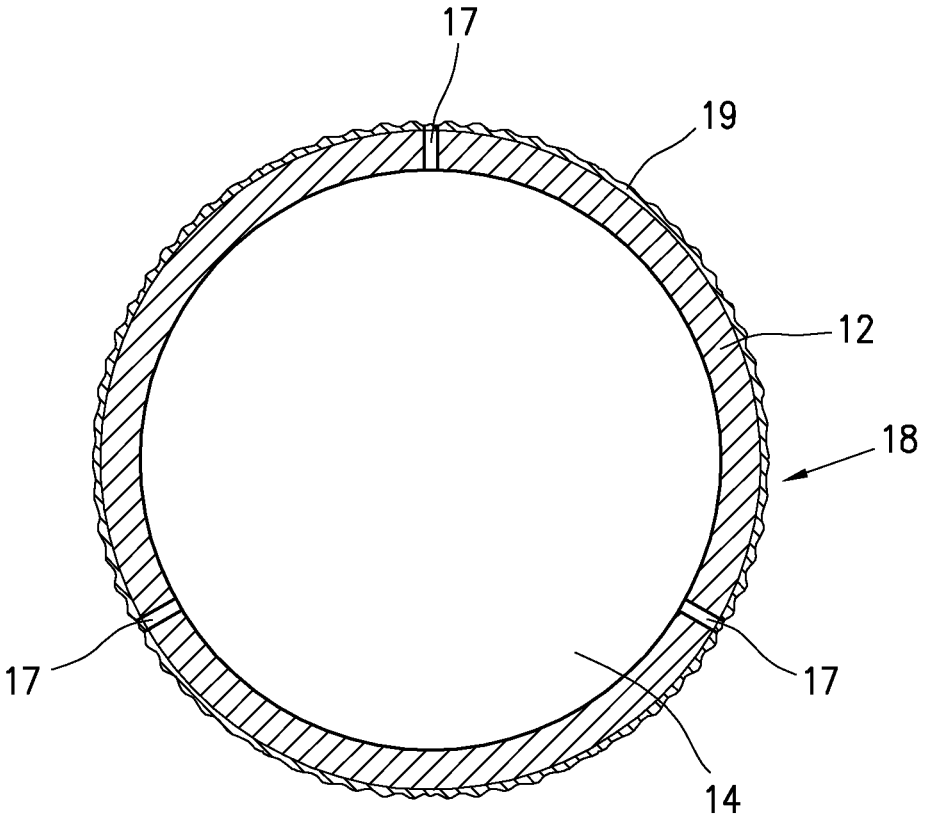
FIG. 2 is an enlarged, cross-sectional view, taken along the line 2-2 of FIG. 1.

FIGS. 1 and 2 show a general spindle 10 suitable for winding up one or more rolls 11 of a plastic film, for example, a stretchable film. The spindle 10 comprises a tubular body 12 in steel material, obtained for example by drawing, suitably ground with a slight taper, for example, of 2 or 3 degrees, with a minimum diameter at the fore end for the removal of the roll 11.

The tubular body 12 is fastened, for example welded at an end of a shaft 13, by which the spindle 10 is supported in order to freely rotate; the tubular body 12 of the spindle 10 has a peripheral wall defining an internal chamber 14 coaxially extending to the tubular body 12. The chamber 14 of the spindle, at the fore end for the removal of the roll 11, is closed by a plug 15, while the rear end can be made to communicate with a pressurised air source through an air supply channel 16 longitudinally extending to the shaft 13.

With reference again to FIGS. 1 and 2, the peripheral wall of the tubular body 12 has a plurality of perforations 17 extending from the internal chamber 14 to an external surface 18 for winding up the plastic film.

The spindle 10 can be of any external diameter, for example, ranging between 35 and 100 mm, while the diameter of the holes or perforations 17 can be about 1 mm, slightly greater or lower. The same number of the holes, and the arrangement thereof, both angularly and along the longitudinal axis of the spindle, can be any one, depending on the length and the outer diameter of the spindle. In the example shown, the holes 17 are arranged at a constant pitch, by alternately providing for holes 17 that are angularly spaced apart by an angle ranging between 90° and 180°; however, any other arrangement of the holes 17 is possible, with respect to the one that has been shown.

Figure 3:
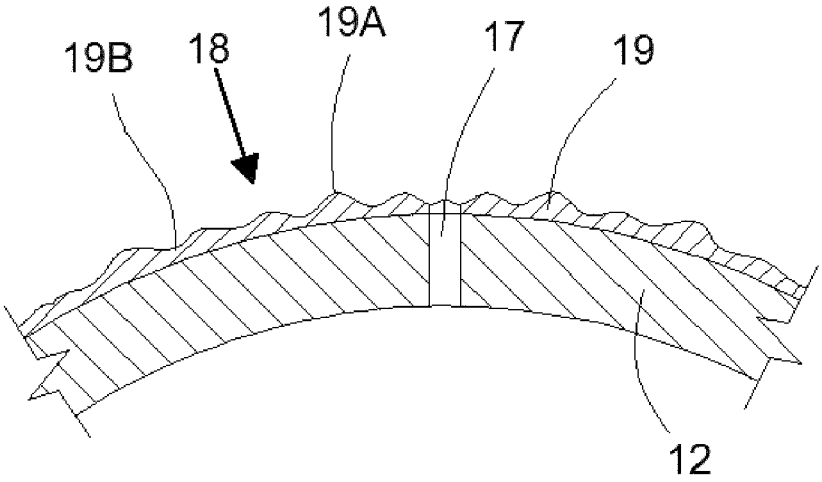
FIG. 3 is an enlarged detail of FIG. 2.

According to the present invention, as shown in FIG. 2 and the enlarged detail of FIG. 3, the tubular wall of the body 12 of the spindle has been coated with a thin protective layer 19 of hard chrome, obtained by a so-called "FLASH" deposition process, consisting in a deposition of chrome having an average thickness ranging between 8-15 μm, and a hardness ranging, for example, between 1000 and 1200 HV.

The choice of the hard chrome FLASH technology, after several attempts, has been made for both the possibility to distribute in a precise and uniform manner the chrome layer 19 without the need for successive grinding operations, and the lower difficulty in obtaining the required surface roughness by dry sandblasting, as explained herein below.

In fact, according to the most innovative aspect of the present invention, for the objects defined before, the external surface of the layer 19 of hard chrome, defining the surface 18 for winding up the roll 11, is subject to a dry sandblasting process in order to form a rough surface having an average roughness Ra ranging between 6 and 6.5 μm.

To the aims of the present invention, based on a conventional definition, by average roughness Ra is meant the arithmetic average of the absolute values of all the ridges 19A and all the valleys 19B of the layer 19 of hard chrome, measured along a sample length.

A number of tests have been carried out with sand having different particle sizes; however, good results have been obtained by using grains of sand having a same dimension ranging between 0.15 and 0.3 mm.

After several attempts, it has been concluded that the use of grains of sand having a greater size would give rise to the risk of creating an excessively high roughness, with consequent increase of the air amount to be supplied to the spindle; furthermore, it would give rise to the risk of damaging the thin chrome layer during the sandblasting process. Finally, excessively high frictional forces would be created in those areas in which the air cushioning would lack due to the excessive extent of roughness, which would hinder the withdrawal of the roll 11.

Instead, from the tests that have been carried out, it has been ascertained that by carrying out a dry sandblasting such as to create an average roughness Ra having the values cited before, it is possible to meet two conflicting need in a single spindle: the first need being to provide the spindle with a rough surface suitable to allow an automatic initial adhesion of the plastic film, without having to generate any air suction through the perforation; the second need being to provide the spindle with a degree of roughness suitable to generate an homogeneous pressurised air cushioning upon withdrawal of the roll, with a considerably reduced pressurised air consumption.

Since it is extremely difficult to represent the irregular profile of a sandblasted surface, the detail of FIG. 3 has to be meant as merely indicative of the general features of the layer 19 of chrome, after the sandblasting process.

Figure 4:
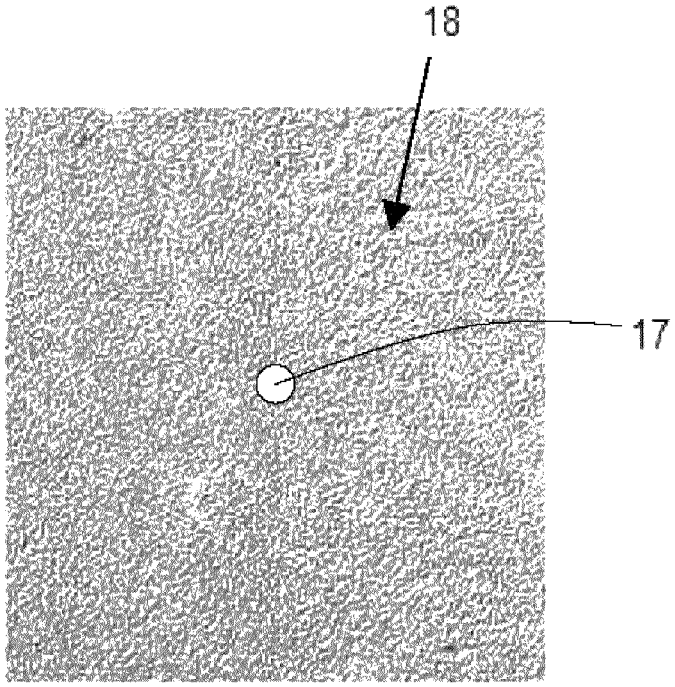
FIG. 4 shows a highly enlarged view of the sandblasted surface of the spindle of FIG. 1.

In turn, FIG. 4 shows, again as a way of example, the roughness characteristics of the sandblasted surface 18 of the layer 19 of chrome of the spindle according to the invention; from FIGS. 3 and 4 it is noted that the random sequence of ridges 19A and valleys 19B generates an infinity of surface micro-paths, with consequent homogeneous distribution of the air flows, thus minimizing the contact points, and, as a result, the frictional forces against the plastic film during the withdrawal of the roll 11.

From what has been stated and shown in the example of the annexed drawings, it will be apparent that a spindle suitable for winding up coreless rolls of a plastic film in winding machines is provided, in which the spindle comprises a tubular body connectable to a pressurised air source, the peripheral wall of which is provided with a plurality of perforations for the generation of air jets, and in which the peripheral wall of the spindle has a thin coating of hard chrome, which has been suitably roughened by a suitable dry sandblasting process in order to create a preset roughness degree.

However, it is meant that what has been stated and shown with reference to the annexed drawings, has been given only by way of illustration of the general and innovative characteristics of the spindle according to the present invention. Therefore, other modifications or variations will be able to be made to the spindle, or parts thereof, without for this departing from the claims.

The invention claimed is:

1. A spindle suitable for winding up and frictionless removing rolls of stretchable plastic film, the spindle comprising:

a tubular body having a cylindrical wall provided with a peripheral surface and at least one coaxially extending internal chamber connectable to a pressurized air source;

a flash deposition of a hard chrome layer having an average thickness ranging between 8-15 μm on the peripheral surface of the tubular body, said hard chrome layer having an external surface for winding up at least one roll of plastic film;

a plurality of perforations which extend from the internal chamber through the wall of the tubular body to the external surface of the layer of hard chrome; and wherein:

the external surface of the layer of hard chrome is dry sandblasted and configured with an artificial average roughness value between 6.0 and 6.5 μm to provide a random distribution of micro-path and pressurized lubricating air fluxes between the chrome layer and the plastic film at the removal of a roll.

2. The spindle according to claim 1, wherein the sandblasted surface of the hard chrome layer has an average roughness (Ra) preferably between 6.2 and 6.3 μm.

3. The spindle according to claim 1, wherein the layer of hard chrome has a hardness between 1000 and 1200 HV.

4. The spindle according to in claim 1, wherein the perforations are extending through the peripheral wall of the tubular body and the layer of hard chrome in angularly spaced apart positions, in correspondence of cross planes spaced apart along a longitudinal axis of the spindle.

5. The spindle according to claim 4, wherein the angular space between perforations ranges between 90° and 180°.

6. An air lubricated spindle suitable for winding up rolls of stretchable plastic films, the spindle comprising:

a tubular body having a peripheral wall provided with an external surface;

at least one internal air-feeding chamber coaxially extending to the spindle;

a plurality of perforations which extend on the peripheral wall of the spindle, from the internal chamber to the external surface of the tubular body;

the external surface of the peripheral wall of the tubular body being provided with a flash deposition layer of hard chrome;

the flash deposition layer of hard chrome having a sandblasted roughened surface provided with a random distribution of surface micro-paths configured with and having an average roughness between 6 and 6.5 microns for generating a homogeneous air cushioning distribution of a lubricating air flow, to reduce the frictional forces between the roughened hard chrome layer and the plastic film during withdrawal of a roll.

7. A method for forming a spindle suitable for winding up and frictionless removing rolls of a stretchable plastic film, the spindle comprising a tubular body having a cylindrical wall provided with a peripheral surface, at least one coaxially extending internal chamber being connectable to a pressurised air source, and a plurality of perforations which extend from the internal chamber through the cylindrical wall of the tubular body; said method comprising the steps of:

providing the peripheral surface of the tubular body, with a flash deposition of a hard chrome layer having an external surface;

subjecting the external surface of the layer of hard chrome to a dry sandblasting; and configuring, by the dry sandblasting, the external surface of the layer of hard chrome with a random distribution of surface micro-paths having an artificial average roughness value between 6 and 6.5 μm, suitable for generating a homogeneous air cushioning distribution of a pressurized lubricating air fluxes between the hard chrome layer and the plastic film at the removal of a roll.

* * * * *